US008435134B2

(12) United States Patent
Tang et al.

(10) Patent No.: US 8,435,134 B2
(45) **Date of Patent: *May 7, 2013**

(54) GOLF CLUB HEAD

(75) Inventors: Larry G. Tang, Carlsbad, CA (US); J. Neil Hall, Carlsbad, CA (US); Sean Griffin, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/488,721

(22) Filed: Jun. 5, 2012

(65) Prior Publication Data

US 2012/0244960 A1 Sep. 27, 2012

Related U.S. Application Data

(63) Continuation of application No. 13/034,046, filed on Feb. 24, 2011.

(60) Provisional application No. 61/311,114, filed on Mar. 5, 2010.

(51) Int. Cl.
*A63B 53/04* (2006.01)

(52) U.S. Cl.
USPC ..... 473/329; 473/332; 473/345; 473/349

(58) Field of Classification Search ..... 473/324–350
See application file for complete search history.

(56) References Cited

U.S. PATENT DOCUMENTS

| | | | | | |
|---|---|---|---|---|---|
| 1,705,997 | A | * | 3/1929 | Quynn | 473/329 |
| 4,398,965 | A | * | 8/1983 | Campau | 148/522 |
| 5,076,585 | A | * | 12/1991 | Bouquet | 473/343 |
| 5,203,565 | A | | 4/1993 | Murray et al. | |
| 5,437,456 | A | * | 8/1995 | Schmidt et al. | 473/291 |
| 5,492,327 | A | * | 2/1996 | Biafore, Jr. | 473/332 |
| 5,735,754 | A | | 4/1998 | Antonious | |
| 5,830,084 | A | * | 11/1998 | Kosmatka | 473/349 |
| 6,042,486 | A | * | 3/2000 | Gallagher | 473/329 |
| 6,086,485 | A | * | 7/2000 | Hamada et al. | 473/329 |
| 6,244,976 | B1 | | 6/2001 | Murphy et al. | |
| 6,332,847 | B2 | | 12/2001 | Murphy et al. | |
| 6,348,013 | B1 | * | 2/2002 | Kosmatka | 473/329 |
| 6,354,962 | B1 | | 3/2002 | Galloway et al. | |
| 6,368,234 | B1 | | 4/2002 | Galloway | |
| 6,386,990 | B1 | | 5/2002 | Reyes et al. | |
| 6,398,666 | B1 | * | 6/2002 | Evans et al. | 473/345 |
| 6,406,378 | B1 | | 6/2002 | Murphy et al. | |
| 6,428,426 | B1 | * | 8/2002 | Helmstetter et al. | 473/330 |
| 6,435,977 | B1 | | 8/2002 | Helmstetter et al. | |
| 6,440,008 | B2 | | 8/2002 | Murphy et al. | |

(Continued)

FOREIGN PATENT DOCUMENTS

| | | | | |
|---|---|---|---|---|
| JP | 04180778 | A | * | 6/1992 |
| JP | 05337220 | A | * | 12/1993 |

(Continued)

*Primary Examiner* — Alvin Hunter
(74) *Attorney, Agent, or Firm* — Rebecca Hanovice; Michael A. Catania; Sonia Lari

(57) ABSTRACT

A golf club head (20) having optimized ball speed robustness is disclosed. The golf club head (20) preferably has one or more channels (100, 110, 120) disposed proximate to a striking face (40), and in some embodiments the one or more channels (100, 110, 120) substantially encircle the striking face (40).

7 Claims, 4 Drawing Sheets

U.S. PATENT DOCUMENTS 6,440,011 B1 * 8/2002 Hocknell et al. ..... 473/342
6,471,604 B2 10/2002 Hocknell et al.
6,478,692 B2 11/2002 Kosmatka
6,482,106 B2 11/2002 Saso
6,491,592 B2 12/2002 Cackett et al.
6,508,978 B1 1/2003 Deshmukh
6,527,650 B2 3/2003 Reyes et al.
6,565,452 B2 5/2003 Helmstetter et al.
6,575,845 B2 6/2003 Galloway et al.
6,582,323 B2 6/2003 Soracco et al.
6,592,466 B2 7/2003 Helmstetter et al.
6,602,149 B1 8/2003 Jacobson
6,602,150 B1 * 8/2003 Kosmatka ..... 473/342
6,607,452 B2 8/2003 Helmstetter et al.
6,612,398 B1 9/2003 Tokimatsu et al.
6,663,504 B2 12/2003 Hocknell et al.
6,669,578 B1 12/2003 Evans
6,739,982 B2 5/2004 Murphy et al.
6,758,763 B2 7/2004 Murphy et al.
6,783,465 B2 8/2004 Matsunaga
6,860,824 B2 3/2005 Evans
6,863,626 B2 * 3/2005 Evans et al. ..... 473/342
6,887,165 B2 * 5/2005 Tsurumaki ..... 473/344
6,994,637 B2 2/2006 Murphy et al.
7,014,570 B2 * 3/2006 Evans et al. ..... 473/329
7,025,692 B2 4/2006 Erickson et al.
7,070,517 B2 7/2006 Cackett et al.
7,082,665 B2 * 8/2006 Deshmukh et al. ..... 29/527.6
7,101,289 B2 * 9/2006 Gibbs et al. ..... 473/329
7,112,148 B2 9/2006 Deshmukh
7,118,493 B2 10/2006 Galloway
7,121,957 B2 10/2006 Hocknell et al.
7,125,344 B2 10/2006 Hocknell et al.
7,128,661 B2 10/2006 Soracco et al.
7,134,971 B2 * 11/2006 Franklin et al. ..... 473/340
7,137,907 B2 11/2006 Gibbs et al.
7,163,470 B2 1/2007 Galloway et al.
7,211,006 B2 * 5/2007 Chang ..... 473/329
7,226,366 B2 6/2007 Galloway
7,252,600 B2 8/2007 Murphy et al.
7,258,626 B2 8/2007 Gibbs et al.
7,258,631 B2 8/2007 Galloway et al.
7,294,064 B2 * 11/2007 Tsurumaki et al. ..... 473/329
7,314,418 B2 1/2008 Galloway et al.
7,320,646 B2 1/2008 Galloway
7,387,577 B2 6/2008 Murphy et al.
7,396,293 B2 * 7/2008 Soracco ..... 473/329
7,396,296 B2 7/2008 Evans
7,402,112 B2 7/2008 Galloway
7,407,448 B2 8/2008 Stevens et al.
7,413,520 B1 8/2008 Hocknell et al.
7,431,667 B2 10/2008 Vincent et al.
7,438,647 B1 10/2008 Hocknell
7,455,598 B2 11/2008 Williams et al.
7,476,161 B2 1/2009 Williams et al.
7,491,134 B2 2/2009 Murphy et al.
7,497,787 B2 3/2009 Murphy et al.
7,500,924 B2 * 3/2009 Yokota ..... 473/332
7,530,901 B2 5/2009 Imamoto et al.
7,549,935 B2 6/2009 Foster et al.
7,578,751 B2 8/2009 Williams et al.
7,582,024 B2 * 9/2009 Shear ..... 473/329
7,717,807 B2 5/2010 Evans et al.
7,749,096 B2 7/2010 Gibbs et al.
7,749,097 B2 7/2010 Foster et al.
7,815,520 B2 * 10/2010 Frame et al. ..... 473/329
7,857,711 B2 * 12/2010 Shear ..... 473/329
D631,119 S * 1/2011 Albertsen et al. ..... D21/759
7,867,105 B2 * 1/2011 Moon ..... 473/314
7,988,565 B2 8/2011 Abe
8,162,775 B2 4/2012 Tavares et al.
8,216,087 B2 7/2012 Breier et al.
2004/0121852 A1 * 6/2004 Tsurumaki ..... 473/344
2004/0192463 A1 * 9/2004 Tsurumaki et al. ..... 473/329
2010/0178997 A1 7/2010 Gibbs
2011/0021284 A1 1/2011 Stites et al.
2011/0151997 A1 6/2011 Shear
2011/0218053 A1 9/2011 Tang et al.
2011/0244979 A1 10/2011 Snyder
2011/0281663 A1 11/2011 Stites et al.
2011/0281664 A1 11/2011 Boyd et al.
2011/0294599 A1 12/2011 Albertson et al.
2012/0034997 A1 2/2012 Swartz
2012/0083362 A1 4/2012 Albertson et al.
2012/0083363 A1 4/2012 Albertson et al.
2012/0142447 A1 6/2012 Boyd et al.
2012/0142452 A1 6/2012 Burnett et al.
2012/0178548 A1 7/2012 Tavares et al.
2012/0196701 A1 8/2012 Stites et al.
2012/0196703 A1 8/2012 Sander

FOREIGN PATENT DOCUMENTS

JP 10155943 A * 6/1998
JP 10263118 A * 10/1998
JP 2002-052099 2/2002
JP 2002052099 A * 2/2002
JP 2002248183 A * 9/2002
JP 2003024481 A * 1/2003
JP 2003210627 A * 7/2003
JP 2004174224 A * 6/2004
JP 2004351173 A * 12/2004
JP 2007136069 A * 6/2007
JP 2007275253 A * 10/2007
JP 2010029590 A * 2/2010
JP 2010279847 A * 12/2010
JP 2011024999 A * 2/2011

* cited by examiner

GOLF CLUB HEAD

CROSS REFERENCES TO RELATED APPLICATIONS

The Present application is a continuation of U.S. patent application Ser. No. 13/034,046, filed on Feb. 24, 2011, which claims priority to U.S. Provisional Patent Application No. 61/311,114, filed on Mar. 5, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a face portion that has optimized compliance and contributes to optimized ball speed robustness.

2. Description of the Related Art

Technical innovation in the material, construction and performance of golf clubs has resulted in a variety of new products. The advent of metals as a structural material has largely replaced natural wood for wood-type golf club heads, and is but one example of this technical innovation resulting in a major change in the golf industry. In conjunction with such major changes are smaller scale refinements to likewise achieve dramatic results in golf club performance. For example, the metals comprising the structural elements of a golf club head have distinct requirements according to location in the golf club head. A sole or bottom section of the golf club head should be capable of withstanding high frictional forces for contacting the ground. A crown or top section should be lightweight to maintain a low center of gravity. A front or face of the golf club head should exhibit high strength and durability to withstand repeated impact with a golf ball. While various metals and composites are known for use in the face, several problems arise from the use of homogeneous and non-homogeneous face materials.

A non-homogeneous face structure typically involves an insert centrally located which requires an exacting fit between two or more distinct elements, but has the advantage of utilizing beneficial material properties in a combination which is not available in each material individually. A homogeneous face structure is simpler to manufacture but is limited to the inherent material properties of one material. The present invention enhances the performance advantages of both homogenous and non-homogeneous face structures by implementing a simple structural change.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. Complete descriptions of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e, which measures club face COR. This USGA test procedure, as well as procedures like it, may be used to measure club face COR.

BRIEF SUMMARY OF THE INVENTION

The present invention is generally directed to a golf club head comprising channels proximate to the striking face of the club which serve to increase ball speed robustness.

One aspect of the present invention is a golf club head comprising a body comprising a crown and a sole, and a face portion attached to the body, the face portion comprising a striking face and a rear section extending laterally rearwardly from the striking face, wherein the rear section comprises a sole side, a crown side, a heel side, and a toe side, wherein the heel side comprises a first channel and the toe side comprises a second channel, wherein the first channel extends along the heel side proximate to and parallel with the striking face, and wherein the second channel extends along the toe side proximate to and parallel with the striking face.

In a further embodiment, each of the first and second channels is approximately 0.06 to 0.25 inch deep, 0.15 to 0.5 inch wide, and 0.5 to 2.5 inches long. The first and second channels may be located in substantially mirror imaged positions with respect to a vertical plane bisecting said striking face, and may extend from the sole side to the crown side. In another embodiment, the first channel may extend less than or equal to half of a length of the heel side, wherein the length is measured from the crown side to the sole side along the heel side. In yet another embodiment, wherein the second channel may extend less than or equal to half of a length of the toe side, wherein the length is measured from the crown side to the sole side along the toe side.

Another aspect of the present invention is golf club head comprising a body having a crown, a sole, a heel end, a toe end, and an opening, a face portion attached to the body at the opening, the face portion comprising a striking face for contacting a ball, wherein the heel side comprises a first channel that extends along the heel end proximate to and parallel with the striking face, and wherein the toe side comprises a second channel that extends along the toe end proximate to and parallel with the striking face. Each of the first and second channels may be approximately 0.06 to 0.25 inch deep, 0.15 to 0.5 inch wide, and 0.5 to 2.5 inches long.

In a further embodiment, the striking face is an insert. In yet another further embodiment, the first and second channels may be located in substantially mirror imaged positions with respect to a vertical plane bisecting said striking face. The first and second channels each may extend from the sole to the crown, and may extend less than or equal to half of a length of the heel end and/or a toe end, respectively, wherein the length is measured from the crown to the sole along the heel and/or toe end.

Yet another aspect of the present invention is a golf club head comprising a body having a crown, a sole, a heel end, a toe end, and an opening and a face portion attached to the body at the opening, the face portion comprising a striking face for contacting a ball, wherein a plurality of channels are defined in the crown, sole, heel end, and toe end proximate the striking face and wherein the plurality of channels substantially encircle the striking face. Each of the channels may be substantially rectangular in shape, having two longer sides and two shorter sides, wherein at least one of the longer sides of each channel is disposed on the body parallel with the striking face. Each of the channels may be approximately 0.090 to 0.250 inch deep, 0.120 to 0.375 inch wide, and 0.400 to 1.500 inches long, and they may be spaced 0.06 to 0.50 inch apart from one another on the body.

In a further embodiment, the plurality of channels comprises six to thirty channels. In yet another further embodiment, the plurality of channels is composed of two continuous channels, each of which substantially encircles the striking face, and each of which is 0.090 to 0.250 inch deep and 0.120 to 0.375 inch wide.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is generally directed to a golf club head that has an improved structure to reduce energy loss during impact of a golf club head with a golf ball and to increase ball speed robustness. A preferred embodiment of the golf club head of the present invention is illustrated in FIGS. 1, 1A, 2, and 3. Alternative embodiments of the present invention are illustrated in FIGS. 4, 5, 5A, 5B, 5C, 6, and 6A. Although four embodiments are illustrated, those skilled in the pertinent art will recognize from this disclosure that other embodiments of the golf club head of the present invention are possible without departing from the scope and spirit of the present invention.

Figure 1:
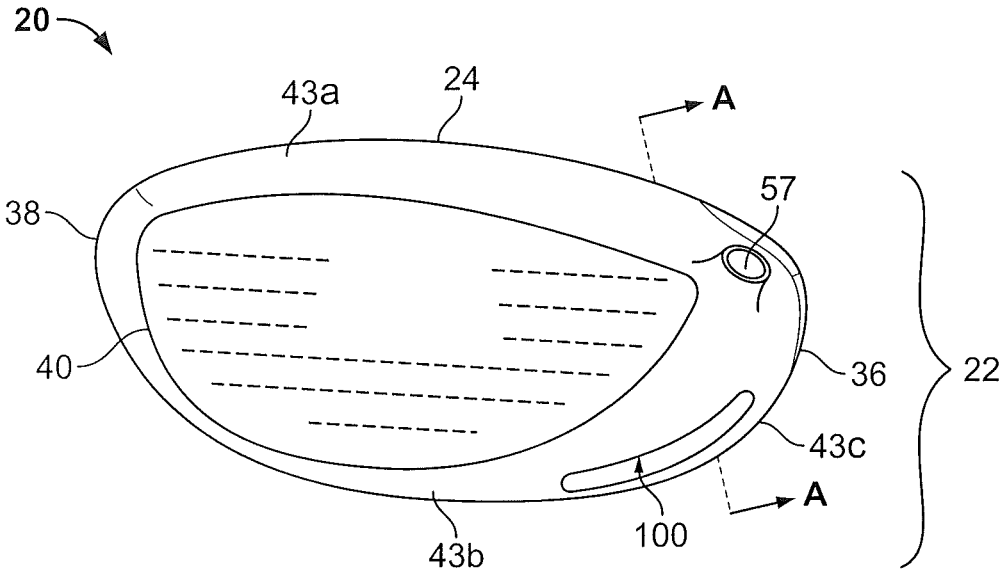
FIG. 1 is a front view of a golf club head according to a first embodiment of the present invention.
Figure 1A:
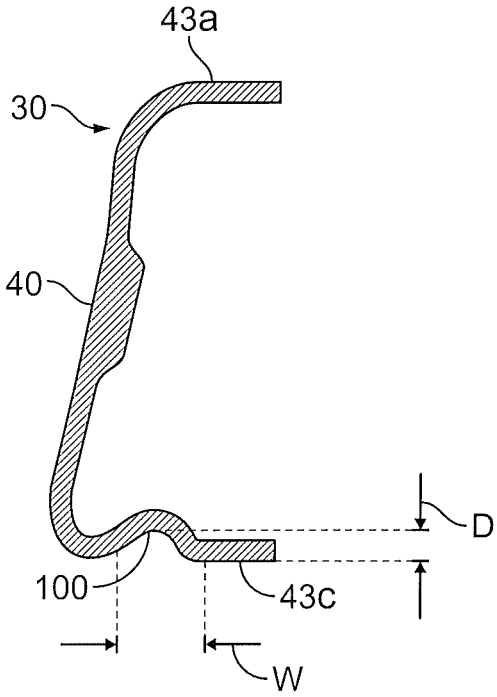
FIG. 1A is a cross-sectional view taken along the line A-A of FIG. 1.
Figure 2:
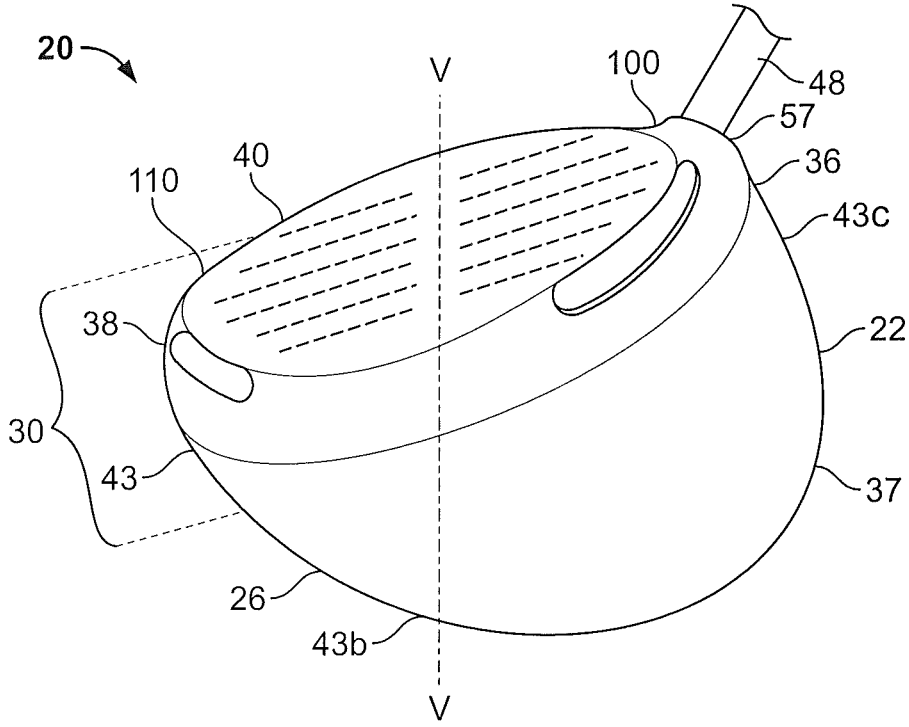
FIG. 2 is an alternative front view of the golf club head of FIG. 1.
Figure 3:
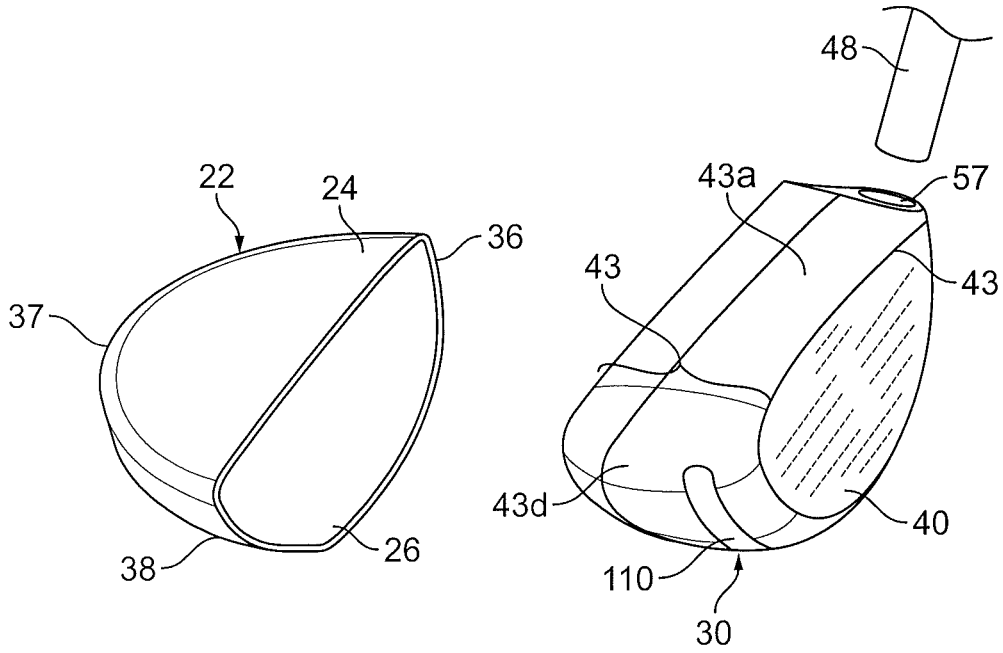
FIG. 3 is an exploded top-view perspective of the first embodiment of the present invention.

As shown in FIGS. 1, 1A, 2, and 3, a preferred embodiment of the golf club head 20 comprises hollow body 22 having a crown 24, a sole 26, a heel end 36, a toe end 38, a hosel 57 to which a shaft 48 may be attached, and a back portion 37. As shown in FIG. 1A, attached to the body 22 is a front portion 30 comprising a striking face 40 and a rear section 43 that extends laterally rearwardly from the striking face 40. As shown in FIGS. 1A, 2 and 3, the rear section 43 has a crown side 43*a*, a sole side 43*b*, a heel side 43*c*, and a toe side 43*d*. Thus, the rear section 43 encircles the striking face 40 a full 360 degrees. However, those skilled in the pertinent art will recognize that the rear section 43 may only encompass a partial section of the striking face 40, such as 270 degrees or 180 degrees, and may also be discontinuous.

In the preferred embodiment, shown in FIGS. 1, 1A, 2, and 3 a first channel 100 is defined in the heel side 43*c* of the rear section 43 and a second channel 110 is defined in the toe side 43*d* of the rear section 43, as shown in FIGS. 2 and 3. As shown in FIGS. 1, 2, and 3, the first channel 100 and second channel 110 extend along the heel side 43*c* and toe side 43*d* of the rear section 43 respectively, proximate to and parallel with the contour of the striking face 40. As shown in FIG. 1A, a cross sectional view of the front portion 30 along lines A-A, the first channel 100 has a discernable depth.

In the preferred embodiment, the first channel 100 and second channel 110 are both narrow, shallow indentations located in the rear section 43, each having approximate measurements of 0.060 to 0.250 inch deep ("D"), 0.15 to 0.50 inch wide ("W"), and 0.50 to 2.5 inches long. In a most preferred embodiment, the channels are 0.15 inch deep, 0.32 inch wide, and 1.5 inch long. The proportions of the first channel 100 and second channel 110 may vary, however, and particularly the lengths. For example, the first channel 100 and second channel 110 may extend from the sole side 43*b* to the crown side 43*a* of the rear section 43, or may extend only halfway, or less than halfway, of the length between the sole side 43*b* and the crown side 43*a*.

In further embodiments, the first channel 100 may be a different length than the second channel 110. For example, the first channel 100 may extend less than half of the length of the heel side 43*c*, as measured from the sole side 43*b* to the crown side 43*a*, and the second channel 110 may extend more than half of the length of the toe side 43*d*, as measured from the sole side 43*b* to the crown side 43*a*.

The locations of the first channel 100 and second channel 110 may also vary. For example, as shown in FIG. 2, the first channel 100 and second channel 110 are located closer to the sole side 43*b* of the rear section 43 than the crown side 43*a*. In another embodiment, the first channel 100 and the second channel 110 may be located closer to the crown side 43*a* than the sole side 43*b*. As shown in FIG. 2, the first channel 100 and second channel 110 may also be located in substantially mirror imaged positions with respect to a vertical plane, the line "V", bisecting the striking face 40. In an alternative embodiment, the golf club head 20 comprises only the first channel 100 or the second channel 110 as described herein.

Figure 4:
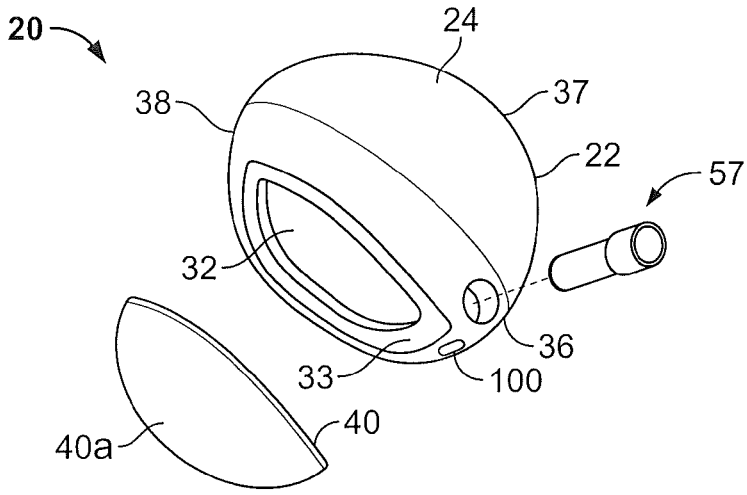
FIG. 4 is an exploded front-view perspective of a second embodiment of the present invention.

A second embodiment of the golf club head 20 of the invention is shown in FIG. 4. In this embodiment, the golf club head 20 has a body 22 comprising a crown 24, a sole 26 (not shown), a back portion 37, a heel end 36, a toe end 38, a hosel 57 to which a shaft 48 (not shown) may be attached, and a recessed portion 33 which, together with the crown 24, sole, 26, heel end, 36, and toe end 38, defines an opening 32 for receiving a face portion. In this embodiment, the face portion is a striking face 40 insert that is attached to the body 22 over the opening 32 defined by the recessed portion 33 and the other elements of the body 22.

In this second embodiment, a first channel 100 is defined in the heel end 36 and a second channel 110 (not shown) is defined in the toe end 38, as described above in relation to the first embodiment of the invention. The first channel 100 and second channel 110 extend along the heel end 36 and toe end 38, respectively, proximate to and parallel with the striking face insert 40. The first channel 100 and second channel 110 are both narrow, shallow indentations in the heel end 36 and toe end 38, each having approximate measurements of 0.060 to 0.250 inch deep, 0.15 to 0.50 inch wide, and 0.50 to 2.5 inches long. In a most preferred embodiment, the channels are 0.15 inch deep, 0.32 inch wide, and 1.5 inch long.

The proportions of the first channel 100 and second channel 110 may vary, however, and particularly the lengths. For example, the first channel 100 and second channel 110 may extend from the sole 26 to the crown 24, or may extend only halfway, or less than halfway, of the length between the sole 26 and the crown 24. In further embodiments, the first channel 100 may be a different length than the second channel 110. For example, the first channel 100 may extend less than half of the length of the heel end 36, as measured from the sole 26 to the crown 24, and the second channel 110 may extend more than half of the length of the toe end 38, as measured from the sole 26 to the crown 24.

The locations of the first channel 100 and second channel 110 also may vary. For example, as described above in reference to the first embodiment of the invention, the first channel 100 and second channel 110 are located closer to the sole 26 than the crown 24. In another embodiment, the first channel 100 and the second channel 110 may be located closer to the crown 24 than the sole 26. The first channel 100 and second channel 110 may also be located in substantially mirror imaged positions with respect to a vertical plane bisecting the striking face insert 40. In an alternative embodiment, the golf club head 20 may comprise only the first channel 100 or the second channel 110 as described herein.

Figure 5:
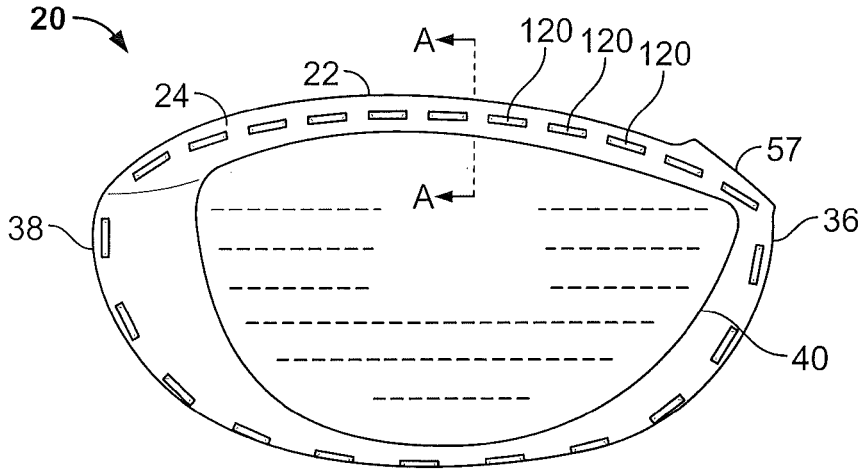
FIG. 5 is a front view of a golf club head according to a third embodiment of the present invention.

A third embodiment of the golf club head 20 of the invention is shown in FIG. 5. In this embodiment, the golf club head 20 has a body 22 comprising a crown 24, a sole 26 (not shown), a back portion 37 (not shown), a heel end 36, a toe end 38, a hosel 57 to which a shaft 48 (not shown) may be attached, and an opening 32 (not shown) defined by the crown 24, sole, 26, heel end, 36, and toe end 38, for receiving a face portion. In this embodiment, the face portion is a striking face insert 40 attached to the body 22 over the opening 32 defined by the other elements of the body 22. The third embodiment further comprises a plurality of channels 120 defined in the crown 24, sole 26, heel end 36, and toe end 38, such that the plurality of channels 120 substantially encircle the striking face insert 40. In an alternative embodiment, the club head comprises a face component with a striking face 40 and a rear section 43 portion as shown in FIGS. 1, 1A, 2, 3, wherein the plurality of channels are disposed in the rear section 43.

Figure 5A:
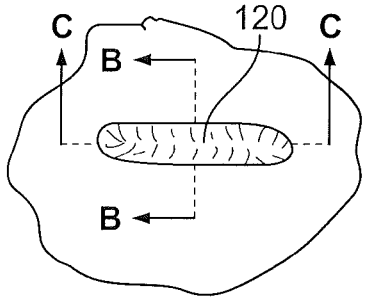
FIG. 5A is a top view of the region circled in FIG. 5.
Figure 5B:
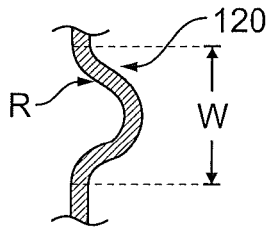
FIG. 5B is a cross-sectional view along the line B-B in FIG. 5A.
Figure 5C:
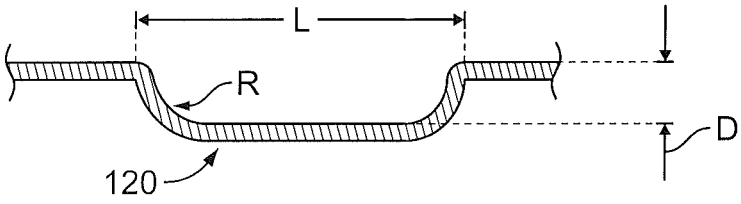
FIG. 5C is a cross-sectional view along the line C-C in FIG. 5A.

As shown in FIG. 5, each of the channels 120 is generally rectangular in shape, having two shorter sides and two longer sides. In the embodiment shown in FIG. 5, the longer sides of each of the channels 120 are disposed on the body 22 parallel to the striking face insert 40. In an alternative embodiment, the channels 120 may be disposed on the body 22 such that their shorter sides are parallel to the striking face insert 40. Those skilled in the pertinent art will realize that the proportions of the channels 120 may vary, but in the preferred embodiment each channel 120, as shown in FIGS. 5A, 5B, and 5C, is approximately 0.090 to 0.250 inch deep ("D"), 0.12 to 0.375 inch wide ("W"), and 0.40 to 1.5 inches long ("L"), with a radius of curvature R. In a most preferred embodiment, each channel is 0.16 inch deep, 0.25 inch wide, and 0.5 inch long.

The channels 120 preferably are spaced 0.06 to 0.50 inch apart from one another on the body 22, such that the edge of one channel 120 is between 0.06 and 0.50 inch away from the edge of the next channel 120, and most preferably are 0.25 inch apart from each other. In the preferred embodiment, there are between six and twelve channels 120 on each of the crown 24 and the sole 26, with a total of approximately thirty channels 120 encircling the striking face.

Figure 6:
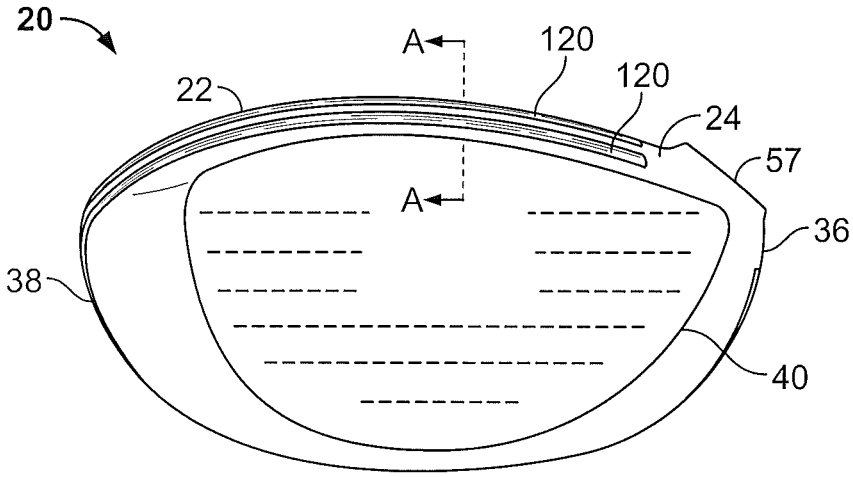
FIG. 6 is a front view of a golf club head according to a fourth embodiment of the present invention.
Figure 6A:
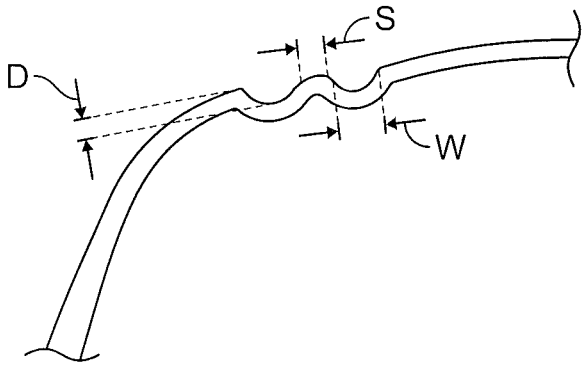
FIG. 6A is a cross-sectional view along the line A-A in FIG. 6.

A fourth embodiment of the golf club head 20 of the invention is shown in FIG. 6. In this embodiment, the golf club head 20 has a body 22 comprising a crown 24, a sole 26 (not shown), a back portion 37 (not shown), a heel end 36, a toe end 38, a hosel 57 to which a shaft 48 (not shown) may be attached, and an opening 32 (not shown) defined by the crown 24, sole, 26, heel end, 36, and toe end 38, for receiving a striking face insert 40. The striking face insert 40 is attached to the body 22 over the opening 32 defined by the other elements of the body 22. This embodiment further comprises two continuous channels 120 defined on the crown 24, sole 26, heel end 36, and toe end 38. In this embodiment, the two channels 120 extend proximate to the striking face insert 40 and substantially encircle the striking face insert. The channels are approximately 0.090 to 0.250 inch deep ("D"), 0.12 to 0.375 inch wide ("W"), and are spaced apart from one another by 0.06 to 0.50 inch ("S"). In a most preferred embodiment, the channels are each 0.16 inch deep, 0.25 inch wide, and are spaced 0.15 inch apart from one another. In an alternative embodiment, the club head comprises a face component with a striking face 40 and a rear section 43 portion as shown in FIGS. 1, 1A, 2, 3, wherein the two channels 120 are disposed in the rear section 43.

The body 22 of the present invention is preferably composed of a non-metal material, more preferably a composite material, and most preferably the composite material described in U.S. patent application Ser. No. 12/939,477, the disclosure of which is incorporated in its entirety herein. In another embodiment, the composite material instead is a continuous fiber pre-preg material (including thermosetting materials or thermoplastic materials for the resin). Other materials that can be used to form the body 22 include thermosetting materials or thermoplastic materials such as injectable plastics. The body 22 is preferably manufactured through bladder-molding, resin transfer molding, resin infusion, injection molding, compression molding, or a similar process.

In alternative embodiments, the body 22 is composed of a lightweight metallic material, such as titanium, titanium alloys, magnesium alloys, aluminum alloys, magnesium, aluminum or other low density metals. In another embodiment, the body 22 comprises a metal sole 26 and a composite crown 24. In yet other embodiments, the body 22 has a multi-material composition such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head 20, when designed as a driver, preferably has a volume from 200 cubic centimeters to 600 cubic centimeters, more preferably from 300 cubic centimeters to 500 cubic centimeters, and most preferably from 400 cubic centimeters to 460 cubic centimeters. The volume of the golf club head 20 also varies between fairway woods (preferably ranging from 3-woods to eleven woods) with smaller volumes than drivers. The golf club head 20 preferably has a mass of no more than 225 grams, and most preferably a mass of 180 to 215 grams.

In the embodiments of the invention, the striking face/striking face insert 40 is preferably composed of a formed metal material. However, the striking face/striking face insert 40 may also be composed of a machined metal material, a forged metal material, a cast metal material or the like. The striking face/striking face insert 40 preferably is composed of a titanium or steel material. Titanium materials suitable for the striking face/striking face insert 40 include pure titanium and titanium alloys. Other metals for the striking face/striking face insert 40 include high strength steel alloy metals and amorphous metals. As shown in FIGS. 1, 2, 5, and 6, the exterior surface 40*a* of the striking face insert 40 typically has a plurality of scorelines thereon.

In the preferred embodiment, the striking face/striking face insert 40 has a variable thickness ranging from 0.065 to 0.170 inch, and comprises one or more of the thickness patterns described in U.S. Pat. Nos. 5,830,084, 6,354,962, 6,368,234, 6,398,666, 6,435,977, 6,491,592, 7,137,907, 7,101,289, and 7258626, the disclosures of each of which is hereby incorporated by reference in its entirety herein, and U.S. patent application Ser. No. 12/711,435, the disclosure of which is hereby incorporated by reference in its entirety herein. In another embodiment, the striking face/striking face insert 40 has uniform thickness in the range from 0.040 inch to 0.250 inch, and more preferably in the range from 0.065 inch to 0.170 inch.

The striking face/striking face insert 40 is preferably co-molded with the body 22 or adhered to the opening 32 subsequent to fabrication of the body 22. In another attachment process, the body 22 is first bladder molded and then the striking face insert 40 is bonded to the recessed portion 33 of the front portion 30 using an adhesive. The adhesive is placed on the exterior surface of the recessed portion 33. Such adhesives include thermosetting adhesives in a liquid or a film medium. In yet another attachment process, the body 22 is first bladder molded and then the striking face/striking face insert 40 is mechanically secured to the body 22. Those skilled in the pertinent art will recognize that other methods for attachment of the striking face insert 40 to the body 22 may be composed without departing from the scope and spirit of the present invention.

The proportions of the golf club head 20 of the present invention may vary, though preferably the depth of the golf club head 20 from the striking face 40 to the farthest point on the back portion 37 ranges from 3.0 inches to 5 inches, and is most preferably 3.74 inches. The height of the golf club head 20, as measured while in address position from the sole 26 to the crown 24, preferably ranges from 2.0 inches to 3.5 inches, and is most preferably 2.62 inches. The width of the golf club head 20 from the toe end 38 to the heel end 36 preferably ranges from 4.0 inches to 5.5 inches, and more preferably 4.57 inches. The height of the striking face 40, preferably ranges from 1.8 inches to 2.5 inches, and is most preferably 2.08 inches. The width of the striking face 40 from the toe end to the heel end preferably ranges from 3.0 inches to 5.0 inches, and more preferably 3.52 inches.

Another aspect of the golf club head 20 of the present invention is directed to a golf club head 20 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 20 preferably has a coefficient of restitution ranging from 0.80 to 0.94, as measured under conventional test conditions, more preferably ranging from 0.82 to 0.89, and most preferably 0.83.

As defined in *Golf Club Design, Fitting, Alteration & Repair, 4th* Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Filling, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention is preferably greater than 3000 g-cm$^2$, and more preferably greater than 3500 g-cm$^2$. The moment of inertia, Iyy, about the Y axis for the golf club head 20 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 20 of the present invention is preferably in the range from 1500 g-cm$^2$ to 3800 g-cm$^2$, more preferably from 1600 g-cm$^2$ to 3100 g-cm$^2$.

The golf club head 20 of the present invention has moments of inertia Ixx, Iyy and Izz and a center of gravity location that are optimized to improve the performance of the club head. An improved robustness efficiency parameter, also referred to herein as "REP," for greater inertial properties for both back spin and side spin optimization for impact variation on the club face is captured by the following equation:

$$REP = \left[\frac{I_{xx}}{(I_{yy} + 1.7(I_{zz}))}\right] * \frac{Dcg}{Rball}$$

wherein Dcg is the distance from the face impact to the club head center of gravity. For convenience, the distance Dcg is taken as the distance from the center of the striking face to the center of mass of the club head. Rball is simply the radius of the golf ball, which is set by the rules of golf. Ixx is the inertia about a fore/aft axis through the center of gravity. Izz is the club head inertia about a vertical axis through the center of gravity. Iyy is the club head inertia about an axis in the heel to toe direction through the center of gravity. In the parameterized relationship, the Izz inertia term is weighted by a factor of 1.7. This factor exists because the hit distribution variation is greater in the near horizontal direction than in the vertical direction. The REP equation optimizes the moments of inertia Izz and Iyy and the center of gravity relative to the moment of inertia Ixx.

The golf club heads of the present invention preferably have a center of gravity located less than 1.7 inches from an exterior surface of the striking plate, and a robustness efficiency parameter of less than 0.41.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A fairway wood-type golf club head comprising:

a cast metal body comprising a sole, and a face portion comprising an opening;

a composite crown;

a metal face insert attached to the body and closing the opening, the face insert comprising a striking face; and at least one channel disposed at least partially on the sole proximate the opening, the at least one channel comprising at least two short sides and at least two long sides, wherein the sole has a length measured from a heel-most point of the sole to a toe-most point of the sole, wherein at the least one channel has a length that is less than 75% of the length of the sole, wherein the at least two long sides of the at least one channel extend parallel to the striking face, wherein the at least one channel has a width of at least 0.20 inch and no more than 0.30 inch, wherein the at least one channel has a depth of at least 0.15 inch, wherein each of the at least two long sides has a length of at least 1 inch, and wherein the golf club head has a depth of at least 3.15 inches and no more than 3.65 inches.

2. The fairway wood-type golf club head of claim 1, wherein the at least one channel has a width of approximately 0.25 inch.

3. The fairway wood-type golf club head of claim 1, wherein each of the at least two long sides has a length of at least 2 inches.

4. The fairway wood-type golf club head of claim 1, wherein the metal face insert is composed of a material selected from the group consisting of steel, titanium alloy, and aluminum alloy.

5. The fairway wood-type golf club head of claim 1, wherein each of the face insert and the body is composed of a steel material.

6. The fairway wood-type golf club head of claim 1, wherein the striking face has variable thickness.

7. The fairway wood-type golf club head of claim 1, wherein the golf club head has a moment of inertia around an X-axis perpendicular to the face portion and parallel with a ground plane when the golf club head is placed at address of at least 1600 g-cm$^2$.

* * * * *